United States Patent [19]

Fricker

[11] Patent Number: 4,532,740

[45] Date of Patent: Aug. 6, 1985

[54] ANCHORING TRACK WITH REMOVABLE FILLER BODY

[76] Inventor: Siegfried Fricker, Wurmberger Str. 30-34, 7135 Wiernsheim, Fed. Rep. of Germany

[21] Appl. No.: 605,695

[22] Filed: Apr. 30, 1984

[30] Foreign Application Priority Data

Apr. 29, 1983 [DE] Fed. Rep. of Germany ..... 33156328

[51] Int. Cl.[3] ..... E04B 1/41

[52] U.S. Cl. ..... 52/98; 52/309.4; 52/576; 52/577; 52/710

[58] Field of Search ..... 52/98–100, 52/309.4, 576, 577, 710

[56] References Cited

U.S. PATENT DOCUMENTS

| | | | |
|---|---|---|---|
| 3,182,423 | 5/1965 | Jennings | 52/99 |
| 3,524,290 | 8/1970 | Sarvay | 52/98 |
| 3,557,503 | 1/1971 | Snyder | 52/98 X |
| 3,667,174 | 6/1972 | Arnett | 52/100 |
| 3,974,620 | 8/1976 | Stegmeier | 52/98 |
| 4,344,265 | 8/1982 | Davidson | 52/99 X |

FOREIGN PATENT DOCUMENTS

| | | | |
|---|---|---|---|
| 239504 | 4/1965 | Austria | 52/710 |
| 1784846 | 1/1959 | Fed. Rep. of Germany . | |
| 1938296 | 12/1964 | Fed. Rep. of Germany . | |
| 1013217 | 12/1965 | United Kingdom | 52/710 |

*Primary Examiner*—J. Karl Bell

*Attorney, Agent, or Firm*—Joseph A. Geiger

[57] ABSTRACT

An anchoring track designed to be embedded in the surface of a structural member of concrete, the track having a C-shaped profile and a styrofoam filler body filling out the interior of the track to prevent the penetration of mortar into the track, the filler body being removable from the embedded track by means of a tear strip which is arranged between the back side of the filler body and the base wall of the anchoring track, in alignment with the slot of the anchoring track. The tear strip, when pulled through the slot of the track, tears out a central profile portion from the filler body to permit easy removal of the profile portions of the filler body remaining underneath the flange portions of the anchoring track.

12 Claims, 3 Drawing Figures

ANCHORING TRACK WITH REMOVABLE FILLER BODY

BACKGROUND OF THE INVENTION

1. Field of the Invention

The present invention relates to structural mounting components of the type which are embedded in cast concrete and, more particularly, to an anchoring track which is designed to be embedded in the surface of a concrete member and fitted with a removable filler body protecting it against mortar penetration.

2. Description of the Prior Art

Embedded anchoring tracks in the ceiling, floor or walls of a structure serve a variety of mounting purposes, including the support of objects by suspension or clamping attachment and/or the support and guidance of objects which are intended to be displaceable along the track. Commonly, the cross-sectional profile of an anchoring track is of rectangular outline, with a central longitudinal slot for the insertion of one or more anchoring members.

The penetration of mortar into an anchoring track during the concrete casting operation can present a serious problem, especially when longitudinal displaceability of an anchoring member along the track is desired. It has therefore already been suggested that the penetration of mortar could be prevented by inserting into the cavity of the anchoring track a filler body which is removed, after the surrounding concrete has set.

Such a solution is suggested in the German Gebrauchsmuster (Utility Model) No. 1 938 296. It involves the creation of a styrofoam filler body through a steam-foaming operation on an enclosed anchoring track which has been filled with polystyrol beads. This solution has the disadvantage of requiring the application of steam and elevated sealing pressures to the anchoring track during the steam-foaming operation. Where only moderate pressure can be applied, this method is subject to the risk that portions of the filler body are lost during pre-installation handling of the anchoring track.

This foamed-in filler body is removed from the embedded anchoring track by breaking it into fragments and retrieving the fragments through the slot of the anchoring track. This removal operation requires a breaking tool and it is very time-consuming and messy.

From the German Gebrauchsmuster (Utility Model) No. 1 784 846 is known a channel-shaped curtain rod which is designed to be embedded in concrete or ceiling plaster, the downwardly facing opening of the channel being closed during the plastering operation by means of a removable filler body of pressed paper or plastic. On the back side of the filler body is arranged a tape which serves to pull the filler body from the slot of the embedded curtain rod. This prior art filler body is designed to be reused and is not intended to be destroyed during removal.

The described curtain rod filler body is not suitable for use with an anchoring track of the type under consideration, because it cannot fill out the entire cross section of the track profile, occupying only a central portion which is as wide as the longitudinal slot of the track. Accordingly, this filler body is incapable of plugging the axial ends of the track, so that mortar flowing around the track would be free to penetrate into the track from both axial ends.

SUMMARY OF THE INVENTION

It is the primary objective of the present invention to devise an improved anchoring track with a filler body which is removable from the track without the use of a tool and which, during the concrete casting operation, closes off the cavity of the track on all sides to positively prevent the penetration of mortar into the track.

The present invention proposes to attain this objective by suggesting an anchoring track designed to be embedded in the surface of a concrete structural member, the anchoring track comprising an anchoring track body in the form of a continuous, cross-sectionally C-shaped profile forming a longitudinal slot between oppositely facing flange portions, a filler body of a cross section which fills out the interior of the anchoring track profile so as to close off both of its axial extremities against the penetration of casting material and means for tearing a central portion of the filler body out of the anchoring track, through its longitudinal slot, so as to separate the filler body into several cross-sectionally separate filler body portions and to permit the removal of the remaining filler body portions from behind the flange portions of the embedded anchoring track.

In a preferred embodiment of the invention, the material of the filler body is styrofoam and the tearing means is a tear strip which is received inside the anchoring track profile and confined between a base wall portion of the track and the filler body. The tear strip has a graspable portion in the form of either a protruding extremity or a protruding intermediate loop portion.

The width of the tear strip is preferable identical to, or slightly smaller than, the width of the longitudinal slot of the anchoring track and transverse aligned therewith, so as to sever the filler body along two substantially parallel separation planes.

The present invention further suggests for the tear strip to be an adhesive-backed tape with tensile reinforcing strands. This tape may be attached to a profile length of the filler body, prior to, or simultaneously with, the axial insertion of the latter into the anchoring track.

Lastly, the invention suggests a way of facilitating the tearing of a central portion from the filler body by arranging longitudinal incisions in the filler body. These incisions may take the form of two longitudinal notches accommodating the longitudinal edges of the two flange portions of the anchoring track profile.

Among the advantages afforded by the present invention are the simplicity and effortlessness with which the filler body can be removed from the embedded anchoring track, and the ease with which the anchoring track can be assembled in production, coupled with a low production cost. The proposed anchoring track and filler body also readily lend themselves for the production of anchoring tracks of different lengths.

BRIEF DESCRIPTION OF THE DRAWINGS

Further special features and advantages of the invention will become apparent from the description following below, when taken together with the accompanying drawing which illustrates, by way of example, a preferred embodiment of the invention, represented in the various figures as follows.

DESCRIPTION OF THE PREFERRED EMBODIMENT

Figure 1:
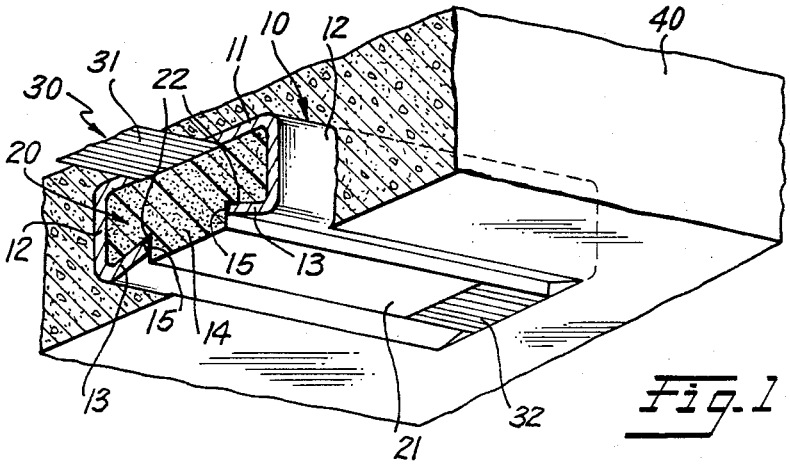
FIG. 1 shows, in a perspective view, an end portion of an anchoring track embedded in the surface of a concrete ceiling, representing an embodiment of the present invention.

Referring to FIG. 1 of the drawing, it can be seen that the anchoring track 10 has the form of a continuous channel of generally C-shaped cross section which is permanently embedded in the surface of a building component 40 of concrete, plaster, or the like. The drawing shows the building component 40 to be a ceiling, but it should be understood that the latter could also be a wall or a floor, for example.

Anchoring tracks of this type are normally fabricated from cut strips of sheet metal in a bending operation or, preferably, from continuous strip stock in a progressive rolling operation. The C-shaped channel profile includes a flat base wall portion 11, two upstanding side wall portions 12, and two inwardly folded flange portions 13 forming a central longitudinal slot 14 between them.

While the overall outline of the track profile is that of a rectangular tube, the flange portions 13 are preferably inclined inwardly, so that their longitudinal edges 15 are recessed to the inside of the rectangular contour of the track cross section, in order to secure the head of an anchoring member (not shown) in the track against rotation.

In the cavity defined by the profile of the anchoring track 10 is arranged a filler body 20 of styrofoam which has a profile matching the inner contour of the track profile so a to fill out the latter. Occupying the longitudinal slot 14 of the anchoring track is an outwardly protruding longitudinal ridge 21 of the filler body 20. The outer surface of the longitudinal ridge 21 is preferably aligned with the outermost points of the two flange portions 13 and with the rectangle circumscribing the cross-sectional contour of the anchoring track 10.

The filler body 20 is a length of a prefabricated styrofoam profile which is arranged to be inserted into the anchoring track 10 from one of its axial extremities with minimal clearance. The ridge 21 is preferable slightly wider than the slot 14, so as to produce an interference fit, for a reliable seal and for a frictional longitudinal positioning of the filler body 20 inside the anchoring track 10.

Between the base wall portion 11 of the anchoring track 10 and the inner face of the filler body 20 is arranged a tear strip 30. This tear strip has an extremity 32 which extends longitudinally beyond at least one axial extremity of the anchoring track 10, the tear strip extremity 32 being arranged to remain exposed in the embedded state of the anchoring track 10 so that it can be grasped and pulled for the destructive removal of the filler body 20 from the anchoring track 10.

Figure 2:
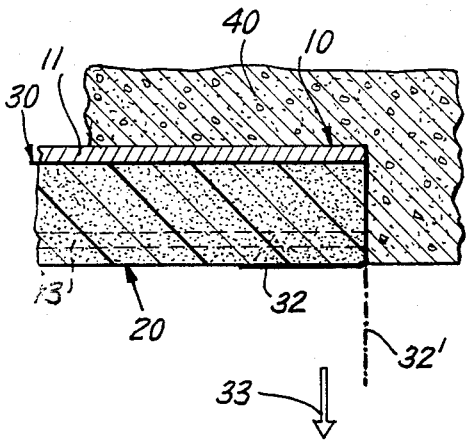
FIG. 2 shows the anchoring track of FIG. 1 in a longitudinal cross section.
Figure 3:
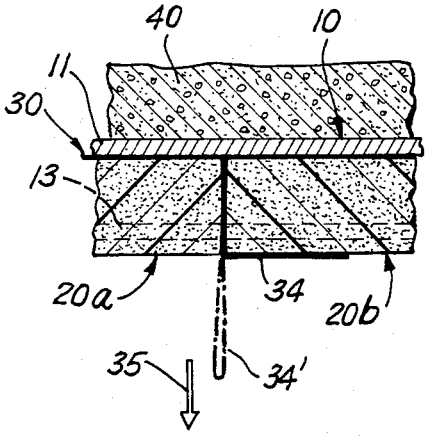
FIG. 3 shows a midportion of an anchoring track with an optional modification of the invention.

The width of the tear strip 30 is preferably equal to or slightly less than the width of the longitudinal slot 14, and the tear strip 30 is transversely aligned behind the slot 14. Consequently, when, as shown in FIG. 2, the lifted extremity 32' of the tear strip 30 is pulled outwardly through the longitudinal slot 14 of the anchoring track 10 in the direction of the arrow 32, it tears from the filler body 20 a central profile portion, severing the filler body 20 along two substantially parallel separation planes. With the central portion of the filler body 20 thus removed, the remaining lateral profile portions of the filler body can be moved from behind the two flange portions 13 to the center of the track profile and removed through its longitudinal slot 14.

The tear strip 30 is preferably in the form of a thin tape. At least near its longitudinal edges, the tear strip 30 may have reinforcing strands. Conveniently, the tear strip 30 is a tensile-reinforced adhesive tape of the kind which is used for strapping purposes, the adhesive backing on the tape having the additional advantage of facilitating the insertion of the tear strip 30 into the anchoring track 10.

For this purpose, the tear strip 30 is attached to the filler body 20 before, or at the time the latter is inserted into the anchoring track 10, and the graspable tear strip extremity, or extremities 32, are simply folded over the filler body extremities and attached to the outer side of its longitudinal ridge 21, as can be seen in FIGS. 1 and 2.

Additionally or in the place of the graspable tear strip extremities 32, the invention suggests the possibility of arranging a protruding tear strip loop 34 between adjoining length portions **20*a* and 20*b* of the filler body 20. The loop 34, when lifted as shown at 34', can be pulled in the direction of the arrow 35 to tear out the central profile portion of the filler body 20, the tearing action progressing in both directions away from the junction. The lifted tear strip loop 34'** has the advantage of being hookable with a simple tool, if desired.

The cross-sectional shape of the filler body 20, in order to accommodate the inwardly inclined flange portions 13, has two longitudinal notches 22 surrounding the longitudinal edges 15 of the anchoring track 10. It has been found that, by arranging sharp corners in the longitudinal notches 22, the tearing of the filler body 20 into separate profile portions is further facilitated. Alternatively, or additionally, it is also possible to make other incisions in the filler body 20, in line with the intended separation planes, during or before the insertion of the filler body into the anchoring track 10.

It should be understood, of course, that the foregoing disclosure describes only a preferred embodiment of the invention and that it is intended to cover all changes and modifications of this example of the invention which fall within the scope of the appended claims.

I claim the following:

1. An anchoring track adapted to be embedded in the surface of a structural member of cast concrete or a comparable mortar-cast material for the suspension thereon and/or attachment thereto, in a fixed or longitudinally displaceable relationship, of a object with the aid of at least one anchoring member which is received in the anchoring track behind oppositely facing flange portions of the track profile, the anchoring track comprising in combination:

an anchoring track body in the form of a continuous profile defining a generally C-shaped cross section, said oppositely facing flange portions flanking a central longitudinal slot facing away from the surrounding surface of the structural member;

a filler body received inside the anchoring track profile, the cross section of the filler body matching the interior cross section of the anchoring track profile, so as to fill out the latter and to close off both extremities of the anchoring track profile against the penetration of mortar during the embedding operation; and means for tearing a central profile portion of the filler body out of the anchoring track, through the longitudinal slot of the track profile, so as to permit removal of the remaining profile portions of the filler body from behind the flange portions of the embedded anchoring track.

2. An anchoring track as defined in claim 1, wherein the filler body is a one-piece styrofoam body.

3. An anchoring track as defined in claim 1, wherein the anchoring track profile includes a base wall portion and two side wall portions linking the base wall portion with the two flange portions; and the tearing means is in the form of a tear strip which is received inside the anchoring track profile and confined between said base wall portion and the filler body, the tear strip having a graspable portion which protrudes from the embedded anchoring track.

4. An anchoring track as defined in claim 3, wherein the graspable portion of the tear strip is an end portion thereof which is folded over an axial extremity of the filler body so as to remain exposed, after the anchoring track has been embedded.

5. An anchoring track as defined in claim 3, wherein the filler body is constituted of at least two separate filler body lengths adjoining each other longitudinally inside the anchoring track profile; and the graspable portion of the tear strip is a loop portion thereof which protrudes outwardly between the longitudinally adjoining filler body lengths so as to remain exposed, after the anchoring track has been embedded.

6. An anchoring track as defined in claim 3, wherein the width of the tear strip is approximately the same as the width of the longitudinal slot of the anchoring track, being transversely aligned with the edges of the slot so as to tear the filler body along two substantially parallel separation planes.

7. An anchoring track as defined in claim 3, wherein the tear strip is an adhesive-backed tape with tensile reinforcing strands.

8. An anchoring track as defined in claim 3, wherein the filler body is a continuous length of foamed material which is insertable into the anchoring track in an axial direction; and the tear strip is an adhesive-backed tape which is attachable to the filler body, prior to its insertion into the anchoring track profile.

9. An anchoring track as defined in claim 1, wherein the filler body has longitudinal incisions facilitating the tearing out of said central profile portion.

10. An anchoring track as defined in claim 1, wherein the flange portions of the anchoring track profile are inclined towards the inside of the anchoring track, so that their longitudinal edges are recessed inwardly from the outer contour of the track cross section;

the filler body includes a longitudinal ridge protruding through the longitudinal slot of the anchoring track profile into approximate alignment with a tangent to the outer cross-sectional contour of the anchoring track profile; and the filler body has two longitudinal notches accommodating the inwardly recessed longitudinal edges of the flange portions.

11. An anchoring track as defined in claim 10, wherein the longitudinal notches of the filler body define incisions in the form of sharp bottom corners facilitating the tearing out of said central profile portion.

12. An anchoring track as defined in claim 10, wherein the width of the longitudinal ridge of the filler body is slightly larger than the width of the longitudinal slot of the anchoring track profile, so a to produce an interference fit between the filler body and the anchoring track body.

* * * * *